United States Patent [19]

Shaffer et al.

[11] 4,338,215

[45] Jul. 6, 1982

[54] CONVERSION OF RADIOACTIVE WASTES TO STABLE FORM FOR DISPOSAL

[75] Inventors: Peter T. B. Shaffer, Grand Island, N.Y.; Rustum Roy; Norman H. Macmillan, both of State College, Pa.

[73] Assignee: Kennecott Corporation, Stamford, Conn.

[21] Appl. No.: 78,119

[22] Filed: Sep. 24, 1979

[51] Int. Cl.[3] ..... G21F 9/34

[52] U.S. Cl. ..... 252/628; 204/1.5; 204/16; 427/5; 427/6

[58] Field of Search ..... 252/301.1 W; 204/1.5, 204/16; 427/5, 6

[56] References Cited

U.S. PATENT DOCUMENTS

| | | | |
|---|---|---|---|
| 2,442,617 | 6/1948 | Rosenblum | 204/14 |
| 2,848,391 | 8/1958 | Fahnoe et al. | 427/5 |
| 2,854,315 | 9/1958 | Alts et al. | 252/301.1 W |
| 3,061,525 | 10/1962 | Grazen | 204/16 |
| 3,320,175 | 5/1967 | Podberesky et al. | 252/301.1 W |
| 3,498,890 | 3/1970 | Divecha et al. | 204/3 |
| 3,904,490 | 9/1975 | Shigeru et al. | 204/16 |
| 3,922,231 | 11/1975 | Carlin et al. | 252/301.1 W |
| 4,056,482 | 11/1977 | Schmeider et al. | 252/301.1 W |

FOREIGN PATENT DOCUMENTS 2131081 1/1973 Fed. Rep. of Germany .

OTHER PUBLICATIONS

McCarthy, G. J. "High-Level Waste Ceramics . . ." *Nuclear Technology* vol. 32, No. 1 (Jan. 1977) pp. 92–105.

*Primary Examiner*—Deborah L. Kyle

*Attorney, Agent, or Firm*—Raymond F. Kramer; Paul A. Leipold; R. Lawrence Sahr

[57] ABSTRACT

Radioactive waste material, such as that resulting from radioactive weapons plant operation or from nuclear fuel reprocessing, in suitable form, such as radionuclide-containing oxide and/or oxyhydroxide and/or hydroxide particles, is held by a metal or metal "alloy" to an electrically conductive cathodic material upon which the metal or alloy is electrodeposited. In this way the radionuclide species including strontium and/or cesium, which are biologically extremely hazardous, are incorporated into a metal matrix held to a base and may be disposed of, as by underground storage, in such form, which is considered to be more resistant to dissolution by ground water and to damage by mechanical stresses arising from tectonic activity than are glasses or ceramics incorporating radionuclides. In improvements of the process and of the resulting radionuclide-including article, the article is electrolytically or otherwise covered or coated with suitably corrosion resistant and mechanical damage resistant covering(s) or coating(s), as by continuing electrodeposition of the metal, sometimes after addition of more material, which is a source of the metal, to a suitable electrolyte, or after replacement of the electrolyte.

23 Claims, 11 Drawing Figures

CONVERSION OF RADIOACTIVE WASTES TO STABLE FORM FOR DISPOSAL

This invention relates to the safe disposal of radioactive wastes. More particularly, it relates to a process for converting radioactive waste material into a disposable article of improved stability, from which release of radionuclides due to exposure to corrosive conditions and/or to mechanical damaging forces can be minimized.

It has been estimated that nearly a hundred million gallons of nuclear weapons wastes are now stored in temporary facilities in the United States alone. Additionally, it is expected that in the future the nuclear power industry will be generating radioactive wastes at an increasing rate from nuclear fuel reprocessing and other operations. Similar wastes are also generated during the mining of radioactive materials and during the manufacture of nuclear fuels. Also, lesser amounts of radioactive wastes result from the production of radioactive materials for medical, analytical, geological, manufacturing and other purposes.

After exhaustion of all efforts to recover and reuse radioactive materials, as by recycling them, the huge quantities of radioactive wastes still remaining must be disposed of safely. The present national plan is that these wastes will be buried in subterranean caverns or mines, such as salt caverns, thousands of feet below ground level. To prevent any possible escape of the wastes and eventual undesirable transport thereof to the surface, the uses of cements, concretes, grouts and other materials to cover the wastes and fix them in place, as solids, has been suggested. To further prevent leaching out of soluble radionuclides in the event that a storage location should be flooded or ground water should seep into the cavern or mine, radioactive wastes have been calcined and incorporated into glasses prior to underground disposal. Additionally, it has been suggested that glass bodies containing such radionuclides should further be embedded in or covered with metal in an attempt to prevent release of the radionuclides that could occur in the event of failure of the glass bodies as a result of stresses imposed due to tectonic activity. In place of glass it has also been suggested that the radionuclides be incorporated into various crystalline ceramics to obtain greater stabilities and lower solubilities.

Although the various methods described above for improving the condition of radioactive wastes before disposal represent significant improvements over mere storage of such wastes in steel drums, the first "disposal" method, they all have various disadvantages, when compared to the present invention. Primarily, those methods dependent on the employment of glass or ceramics result in products which are subject to being cracked and broken, especially when subjected to shear and/or tensile forces, as in underground storage, when rock strata about them shift slightly. Glasses may also fail as a result of the volume changes accompanying heat—and/or radiation-induced phase changes. For some processes, such as those for the manufacture of monolithic glass or consolidated ceramic forms, very high temperatures, e.g., 1,000°-1,300° C., may be required. The present invention, utilizing a metal matrix (and preferably with a metal covering, too), results in a product which is of improved tensile strength and malleability, and therefore is tougher, so that there is a significantly lesser chance of failure due to shock, impact or tectonic forces to which it may be subjected in storage. A concomitant advantage of the article of this invention over monolithic glasses incorporating radionuclides, due to the superior mechanical properties of the present product, is that the articles made are easily transported from place to place with less danger of rupture due to rough handling and therefore may be more readily moved to different temporary storage sites and to an ultimate disposal site without fear of any release of radioactive material. The metal matrix is a good conductor of heat, thereby lowering the temperature and helping to lower rates of corrosion, leaching, etc., which often increase directly with temperature increases. In addition, metals are relatively insensitive to ionizing radiation and even a poorly crystalline oxide or hydroxide of a radionuclide is likely to be less soluble in ground water than a glass of similar radionuclide content. Furthermore, the product is obtainable by a manufacturing method which lends itself to automatic and remote controls, for safety of personnel, and which can be undertaken at about room temperature or slightly higher, as a result of which substantial energy savings can be achieved. Additionally, because cesium and ruthenium wastes decompose at elevated temperatures, these low temperature methods avoid losses of such hazardous materials.

In accordance with the present invention there is provided a method for converting radioactive waste material into a stable article for disposal or storage which comprises electrolyzing a bath containing ions of a corrosion-resistant, electrodepositable metal or of a plurality of materials including at least one such metal, in the presence of a solid state radioactive waste material which contains a radionuclide selected from the group consisting of strontium 90 and cesium 137 and mixtures thereof in one or more oxide and/or oxyhydroxide and/or hydroxide forms so that the metal or materials including metal is/are deposited on a cathode and bind(s) the radioactive waste thereto. Preferably, the radioactive waste treated is calcined weapons waste or wastes from nuclear fuel reprocessing, the cathode and the matrix metal are of copper or other similarly corrosion resistant and electrodepositable metal, and the electrolyte dissolves little, if any, of the radionuclide compound(s) of the waste, e.g., 5% or less, preferably less than 0.5 or 0.1%. Also, it is preferred that the article resulting from the process described be covered or overcoated, either electrolytically or otherwise, with a corrosion resistant metal or other suitable coating, as by continuing electrodeposition of the matrix metal after consumption of all or substantially all of the radioactive waste material, or by electrodeposition of covering metal or alloy from a new or replenished bath. While the plating metal may be codeposited with finely divided particles of radionuclide compounds, it is sometimes preferable to pelletize the radionuclide compounds resulting from treatment of the waste and then hold them to a conductive substrate by simultaneously metal coating them and the substrate. In such operations, and when fine particles of radionuclide compound are being electrodeposited, it may be desirable to treat the pellets or powders first, as by coating or mixing with conductive powder, to increase surface electrical conductivity and to reduce solubility. The described process may be continuous or of the batch type. Also within the invention are the described articles and a method for disposal of radioactive waste materials in the form of such an article.

The invention will be readily understood from the present specification, including the following description, taken in conjunction with the drawing, in which.

Figure 1:
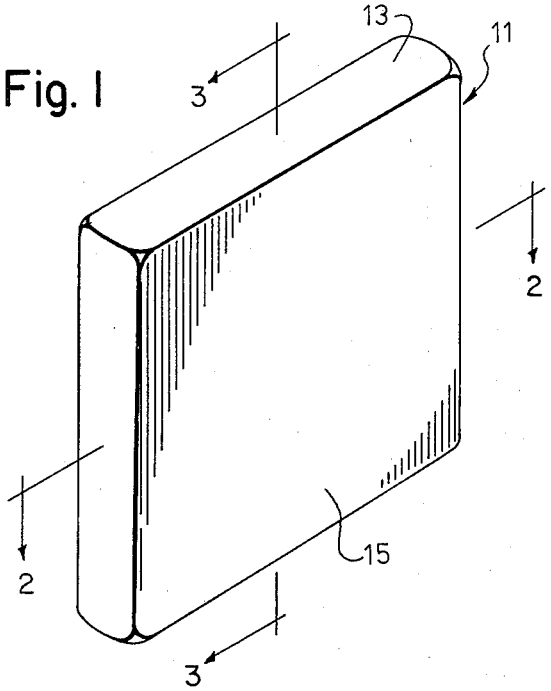
FIG. 1 is a perspective view of a particularly simple flat form of an article of this invention.
Figure 2:
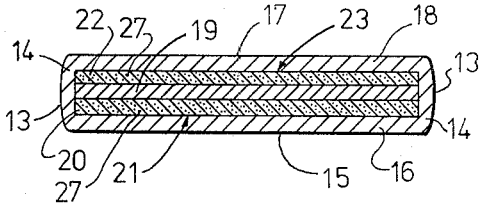
FIG. 2 is a sectional view of the article of FIG. 1 along plane 2—2 of FIG. 1.

In FIG. 1 numeral 11 represents a finished stable article containing radioactive waste material in particulate form dispersed in a matrix of electrocodeposited metal. In the article shown the ends 13 are rounded and the major surfaces, represented by face 15, are substantially flat, with the article being of relatively thin and flat, rectangular, round cornered form. Face 15 and rounded ends 13 are of electroplated, corrosion resistant metal or metal alloy, preferably the same as the interior matrix for the radioactive particles, but do not contain any such particles (or contain very little of them, e.g., less than 0.1% by weight).

FIG'S. 2 and 3 show major surface deposits 16 and 18 and ends (or sides) deposits 14, of electrodeposited corrosion resistant metal, surrounding an internal electrically conductive metal piece 19, which served as a cathode in the codeposition of coatings 21 and 23 primarily onto its major surfaces. Such coatings, in this embodiment, are continuous matrices 20 and 22 of the same metal as piece 19, but in them there are dispersed finely divided particles 27 of radionuclide in insoluble or relatively insoluble (in water) form, as oxides, oxyhydroxides or hydroxides or any mixture thereof, but preferably as oxides. The radionuclides are those obtained from weapons wastes or from the reprocessing of nuclear fuels or from other sources, which preferably have first been calcined to the oxide or other suitable hydration resistant compound. Although, as illustrated, the radionuclide compounds are in finely divided particulate form before deposition, the geometry of said form may be changed and the particles may be coated or otherwise treated to modify their deposition characteristics. As is shown in later FIG'S. 10 and 11, they may be pelletized or otherwise converted to larger sizes, which also may be pre-tested. In FIG'S. 2 and 3 the deposits 21 and 23, shown on the major surfaces of the cathode material 19, are similar to those on the ends of such material but the latter will, in general, be of greater metal content in proportion to the radionuclide content than the deposits on the major surfaces (due to lesser settling of the radioactive waste on the ends). The major article faces shown are 15 and 17.

Figure 4:
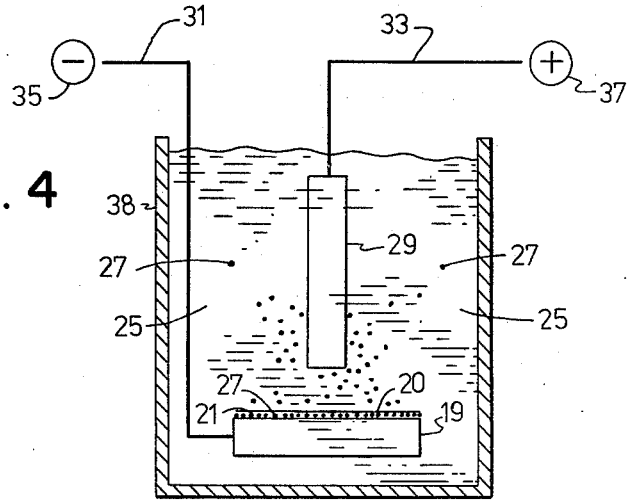
FIG. 4 is a partially schematic view of an electrolytic cell for codeposition of particles of radionuclide-containing material and a metal onto a metal cathode.

In FIG. 4 there is shown schematically the electrocodeposition onto cathodic plate 19 of electrodeposit 21 from electrolyte 25 which may be agitated with a stirrer or stirrers, not shown. In the electrolyte, which is preferably aqueous, there are present ions of an electrodepositable metal, as a result of dissolving a corresponding metal salt in the electrolyte. The ions are electrodeposited as the corresponding metal in the form of a continuous matrix 20, which includes, surrounds and holds the insoluble radionuclide-containing oxides (or other insoluble compounds), shown as particles 27, shown in the matrix and shown dispersed in electrolyte 25. As illustrated, such particles are assisted in being deposited by gravitational forces. Also shown in FIG. 4 are an anode 29, insulated conductive wiring 31 and 33, and representatives of the positive and negative terminals 37 and 35 of an external power supply which is a source of direct electrical current flow. Such elements or parts are shown housed in a vessel or walled container 38, and in combination comprise an electrolytic cell for deposition of radionuclide-containing particles in a metal matrix.

Figure 5:
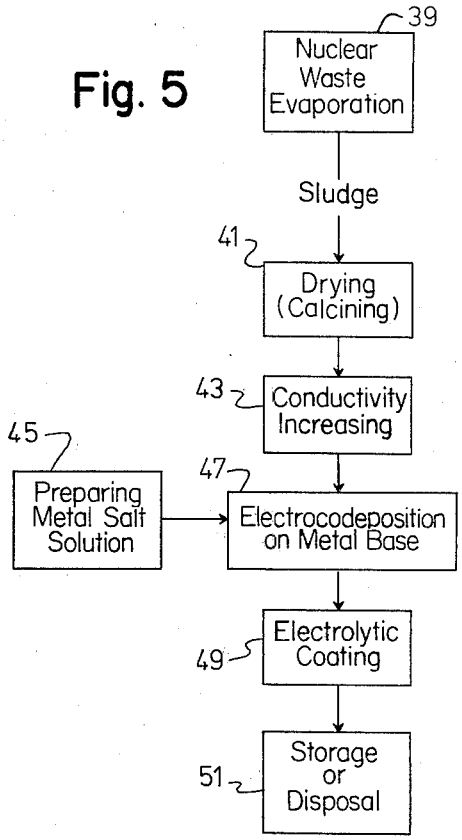
FIG. 5 is a schematic flow diagram showing various steps in the conversion of a radioactive waste material to stable form for ultimate disposal thereof.
Figure 3:
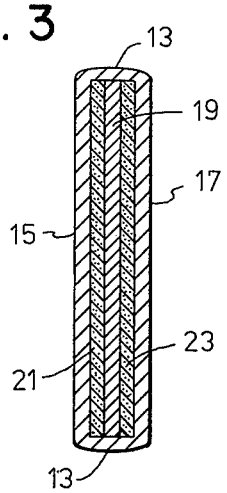
FIG. 3 is a sectional view of the article of FIG. 1 along plane 3—3 of FIG. 1.

In FIG. 5 the step represented by numeral 39 is the conversion to a sludge or slurry of an aqueous nuclear waste solution or suspension. This is usually effected by evaporation of the continuous medium and the product resulting may contain insoluble particles of radionuclide(s), preferably in oxide, oxyhydroxide and/or hydroxide forms. However, such conversion to a sludge or slurry may be by other means, including sorption by zeolites and the utilization of thickening or solidifying agents or other materials, which may promote subsequent drying of the waste solution or obtaining of desirable forms thereof after drying. In some cases the nuclear waste suspension may be evaporated directly, despite being relatively dilute, but usually for best evaporation a thickened liquid or sludge will be preferred as a starting material. Drying or calcining of the sludge, usually to oxide, oxyhydroxide or hydroxide form, preferably to the oxide, is effected at step 41 and, although it is not shown, the dried product may be further size reduced, agglomerated or pelletized for best dispersion and/or most desirable settling and codeposition rates and characteristics, e.g., reduced solubility in the electrolyte. Increasing particle size helps to diminish solubility and so is often preferable. Before or after such size changing operation (or in the absence of it) it is preferred that to promote codeposition the conductivity of the normally poorly conductive or even insulating oxides will be increased, as by electroless deposition thereon of conductive material, intimate mixing with a finely divided conductor, spray treatment with metal or other application of a conductive substance or substances to the dried particles. Often, metals are preferred as the conductive materials, but graphite, especially colloidal graphite, has also been found to be very useful. After subjection of the particles to a suitable conductivity increasing operation 43 (which may sometimes be omitted), the produce thereof (if finely divided) is dispersed in a metal salt solution (usually an aqueous electrolyte) for codeposition of the radionuclide-containing compound and metal onto a metal base. The making of the metal salt solution is represented at 45 and the solution is shown mixed with and utilized with the radionuclide-containing compound in electrodeposition step 47. In FIG. 4 coating onto one major surface of a conductive cathode is shown and in codeposition step 47 such coating is effected and additionally, coating of the other major surface of the cathode may be carried out after a 180° rotation thereof subsequent to depositing of a sufficient thickness of metal matrix-radionuclide-containing compound on the first major cathode surface. Step 49 of FIG. 5 represents a subsequent electrolytic coating of the article with a suitable protective metal or binary metal alloy (which may or may not be the same as the matrix material) to provide additional corrosion resistance. While such step is highly preferred, it is within the present invention to utilize the uncoated article of operation 47, and it is also within the invention to utilize such product when it is coated on only a single surface (usually a major surface) of the cathodic base material. After completion of the coating operation, represented in step 49 (after 47 if subsequent coating is not used) the article is stored or disposed of, as at 51, preferably being ultimately disposed of in safe underground storage. The process described is also readily adaptable to electrolytic (and electroless) deposition of pellets or comparatively large bodies of radwaste onto base materials.

Figure 6:
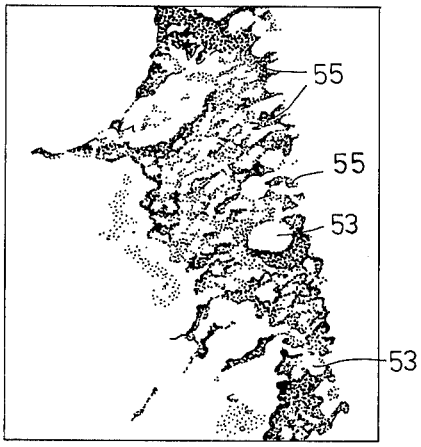
FIG. 6 is a micrograph, obtained with a scanning electron microscope, of a polished cross-section of a portion of a codeposited article of the present invention (but made from simulated radioactive waste material)
Figure 7:
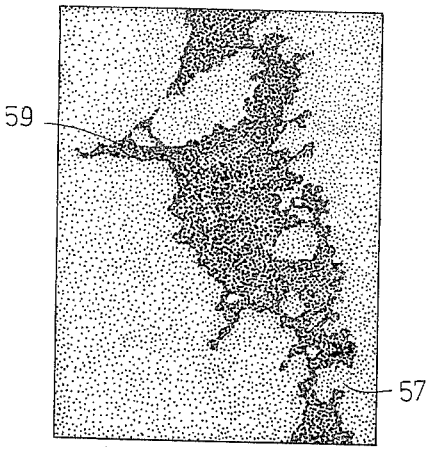
FIG. 7 is a corresponding elemental map obtained by using an energy-dispersive X-ray analyzer attached to the scanning electron microscope employed to obtain the micrograph of FIG. 6, and shows the distribution of the electrodeposited copper in the article.
Figure 8:
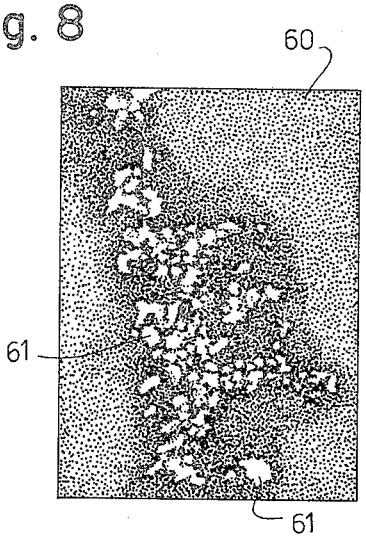
FIG. 8 is a cathode ray tube display of the secondary X-rays, corresponding to the area of FIG. 7, showing the distribution of silicon in such article.

In FIG. 6, a micrograph of a codeposited metallic matrix and particulate calcined simulated radioactive waste onto a metal base, the metallic matrix, largely copper, is shown at 53, and the dark areas of the codeposited calcined radioactive waste particles entrapped by the matrix are shown at 55. In FIG. 7 the copper matrix or plating is shown at 57 and dark areas 59 indicate deficiencies of copper. In FIG. 8 the matrix 60 is of copper and light areas 61 indicate an excess of silicon (waste).

Figure 9:
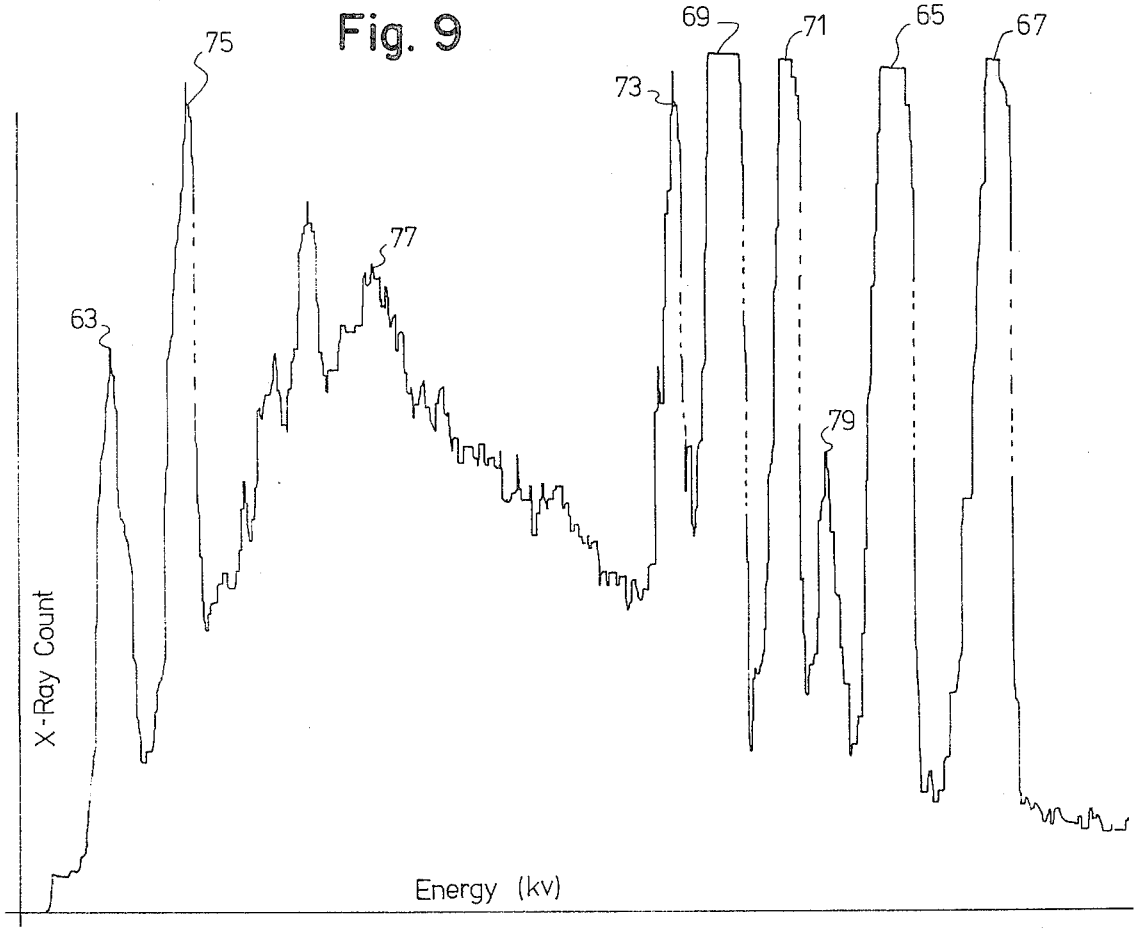
FIG. 9 is a curve of X-ray count vs. energy, obtained by analyzing the X-rays produced by the electron beam impinging on the particulate radioactive waste material in the article of FIG. 6.

In FIG. 9, which is a graph of X-ray peak height vs. X-ray energy, the presence of copper is indicated by the peaks at 63, 65 and 67, the presence of iron is indicated at peaks 69 and 71, manganese is shown at 73, aluminum is characterized by the peak 75, uranium is shown at 77 and nickel is detected at 79. Such materials are known constituents of typical radioactive waste (as radionuclides), with radioactive cesium and strontium, present as oxides, oxyhydroxides and hydroxides in many cases.

Figure 10:
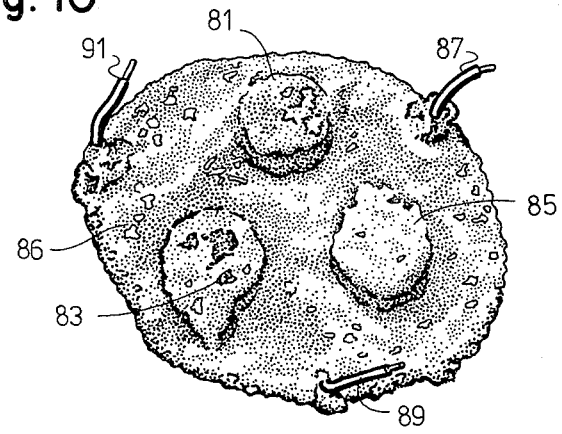
FIG. 10 is a photograph of an article of this invention, illustrating an electrodeposited metallic coating on a metallic cathode, holding pelletized calcined simulated radioactive sludges to such cathode.

In FIG. 10 typical contours 81, 83 and 85 of deposited and entrapped pelletized particles are shown in a matrix 86 of copper. The pellet at 81 includes one part of Savannah River sludge plus nine parts of copper powder (1–5 microns in diameter), that at 83 is of two parts of Savannah River sludge and eight parts of copper powder and that at 85 is of eight parts of copper powder and two parts of a standard PW-4b calcine prepared by Battelle Northwest Laboratories, a more or less crystalline mixture of oxides containing 2 to 5% of residual hydroxides and nitrates, a non-radioactive representation of a waste from the reprocessing of spent Zircaloy-clad uranium oxide fuel elements from a pressurized water reactor by the Purex process. The pellets are bound to a cathodic disc base, not shown in this view, which has insulated electrically conductive wires 87, 89 and 91 connecting it with a negative electrical source to make it cathodic for electrodeposition of the copper. Over the surfaces of the particles and the base cathode is electrodeposited from solution the coating of copper 86, which holds the pellets in place.

Figure 11:
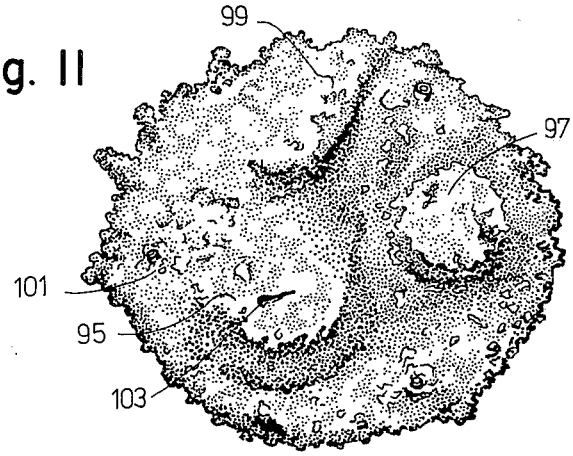
FIG. 11 is a corresponding view of another article of this invention wherein the pellets employed are of differently treated calcined waste.

In FIG. 11 there is shown a view similar to that of FIG. 10 but in which the right "hillock" 97 is a copper covered compressed and graphite coated pellet of Savannah River sludge and the other two "hillocks", 99 and 95, respectively, are the slumped remains of initially uncoated and gold sputtered pellets of Savannah River sludge, respectively. It is noted that the lower "hillock" at 103 is not completely sealed over by the electrodeposited copper 101.

The radioactive wastes disposed of by the method of this invention and incorporated in the articles thereof may be any of a variety of types. Although wastes resulting from mining and milling operations may be treated by the process of this invention and may be made into the articles thereof, it is primarily intended that the invention be applied to the disposal of weapons wastes and nuclear fuel wastes, which, before the electrodeposition operation hereof, are in, are convertible to or have been converted to particulate form (including pellet and fiber forms). At present such wastes are stored or buried at various locations around the country, including Hanford Reservation, near Richland, Wash.; Savannah River Plant, near Aiken, S.C.; Oak Ridge National Laboratory, Tenn.; Los Alamos, N.MEX.; West Valley, N.Y.; Beatty, Nev.; Sheffield, Ill.; Maxey Flats, Ky.; and Barnwell, S.C. The various wastes, whether in liquid or solid form, may include a variety of radioactive materials and byproducts of radioactive reactions, such as radioactive cesium, strontium, ruthenium, uranium, zirconium, niobium, barium, plutonium, yttrium, europium, and other rare earths. Usually such radionuclides are present in mixtures but they may be treated singly, too. Of course, this list is not exhaustive and the present invention is useful in immobilizing, entrapping and making suitable for ultimate disposal various other radionuclides. The main characteristics of such products, so that they are treatable by the methods of the present invention, relate to their insolubility or limited solubility in the electrolyte employed in the practice of the present process. Thus, while there may be some electrodeposition or electroplating out of dissolved radioactive ions in the practice of this invention, primarily the invention relates to the holding or codeposition onto a suitable base material of particulate, pelletized, fibrous or fibrized insoluble or relatively insoluble radionuclide componds, which are held to such a base by the simultaneous electrodeposition of a metal, which is usually non-radioactive. The radionuclides mentioned, usually including cesium and/or strontium (these are both readily incorporated into biological systems, e.g., human bones, and are therefore potentially extremely hazardous), if initially in liquid form, such as dissolved in an aqueous acidic medium, may be converted to particulate form by treatment with neutralizing chemicals, spray drying, calcining, etc., in known manner. It has been found that the preferred forms of the radionuclides for the practice of the present invention are as oxides, oxyhydroxides and hydroxides, with the oxides being most preferable. Such materials are considered to be of acceptable insolubilities in electrolytes normally employed for the plating out of the metals utilized in the present process. However, by utilizing different electrolytes, usually aqueous, but sometimes also non-aqueous, different metals may be plated out and other forms of radionuclides, which will be of acceptable insolubility, may be satisfactorily employed.

With the radionuclide compounds there may be present various other materials normally found in radioactive wastes. Thus, such wastes may include insoluble forms of iron, copper, aluminum, manganese, lead, nickel, silicon, mercury, cobalt, silver, cadmium, calcium and tin, usually in non-radioactive forms. Additionally, more complex compounds, often utilized in processing or purification of radioactive materials, may be present, e.g., synthetic and natural zeolites and clays. It is preferred that such materials also be present in oxide, oxyhydroxide or hydroxide form or any mixture thereof but the zeolites and clays need not be changed to such form. Normally, the percentage of radionuclides in the particulate (including pelletized and fibrous) calcined radioactive wastes typically will be from about 0.5 to 10% thereof, e.g., 1 to 4%, but the present invention is also applicable to wastes containing greater percentages of radionuclide or radionuclide mix, such as up to 25% thereof, and the invention also may be utilized to deposit higher concentrations, including a pure or essentially pure radionuclide compound, on a base for disposal, or for any other suitable purpose or application.

Single metals or mixtures of a plurality of such metals may be electrodeposited with the radioactive waste material to hold it to a suitable base. Of such metals manganese, iron, cobalt, nickel, copper, zinc, tin and lead and any of the several electroplatable mixtures of these, e.g., binary mixtures, are preferred when aqueous electrolytes are being utilized. However, it is normally difficult to deposit ternary, quaternary or higher alloys, except for those of copper, tin and zinc. Some of the properties of stainless steels may be obtained by depositing alloys of iron and either chromium and nickel, and the resulting products may be considered as "stainless steels". In addition to the metals mentioned it is also possible to plate gold, silver, palladium, platinum, rhodium, iridium, osmium and ruthenium from aqueous electrolytes but such materials are normally considered to be too expensive for economic processing, except as thin coatings. Indium is of too low a melting point to be of practical interest. Included among other materials platable from suitable baths are rhenium, mercury, thallium, arsenic, antimony, bismuth selenium, tellurium and cadmium. Generally such materials will not be of practical interest but some of them, such as mercury and cadmium, may be usefully plated as alloys. When non-aqueous electrolytes are utilized aluminum may be electrodeposited, as may be alloys of cobalt with tungsten, iron with tungsten, iron with molybdenum, tungsten with chromium, molybdenum with chromium, tungsten with nickel, and molybdenum with nickel. Also, while it is normally desired to avoid high temperature processing and the avoidance of such processing is one of the advantages of the present invention, the method described may be applied with respect to fused salt electrolyses, whereby electrodeposition of aluminum, titanium, zirconium, hafnium, vanadium, niobium, tantalum, molybdenum, and tungsten, and alloys thereof is possible.

The cathode or base material, onto which the radioactive waste is to be bound by an electroplated substance, is preferably a metal but other suitable cathode materials, such as graphite, carbon and impregnated or otherwise treated graphites may also be employed. Among the metals utilized are copper, nickel, iron, chromium, lead, tin, zinc, manganese and cobalt and mixtures thereof. Steels, including stainless steel, may also be employed. Instead of using pure or essentially pure cathode metals there may also be utilized alloys or mixtures of such materials, such as are described with respect to the plating metals or alloys above. Additionally, in such alloys non-metals may also be present, e.g., carbon, silicon, phosphorus and sulfur.

As illustrated in the drawing, the cathode or base of the present articles, onto which the radioactive waste material will be held by an electrodeposited coating or covering, is preferably of thin flat form so as to increase the efficiency of particulate deposition thereon. Normally the thickness of the cathode will be within the range of one mm. to one cm. but this may be varied in special applications. The other dimensions of the cathode are essentially unlimited, but usually will be from 10 cm. to 5 m., preferably 30 cm. to 2 m., in either dimension, if rectangular, with a length:width ratio being from about 1:1 to 1:50, preferably 1:2 to 1:10. However, other shapes such as circular, elliptical and curved, may also be employed. Additionally, instead of the electrode being flat, it may be curved or otherwise shaped, sometimes to assist in temporarily holding the particles, pellets or fibers of radioactive material in place before plating of the coating thereover. The deposit of radioactive material in a matrix of metal or alloy will usually be of a thickness in the range of one mm. to five cm. but this may be increased to as much as one m. or even more, in particular applications. Also, it is within the invention, especially when very thick deposits of radioactive materials in metal matrices are produced, to overplate such deposits periodically with a metal or alloy without radioactive material so as to furnish a surface onto which the radionuclide compounds may be more readily deposited. Similarly, such surfaces, cathode surfaces and the surfaces of already laid down deposits may be modified, as by roughening, gouging, dishing or pitting, knurling, scratching or other suitable means, so as to make them better able to hold the radioactive waste, in whatever form it is employed, in position for electroplating thereover of a metal matrix. In some cases the waste may first be cemented or fixed in place, before plating over it.

In practicing the invention a metallic cathode is positioned in an electrolytic bath containing ions of the metal to be electrodeposited and the particles, pellets or other form of calcined radioactive waste (or otherwise made oxide, oxyhydroxide or hydroxide or equivalent fastenable form) is in contact with the cathode or capable of being brought into contact with it during electroplating. In one form of the invention a stirrer may be utilized and the particulate radioactive waste may be in small particle form, usually of a size from 1 micron to 1 mm. in diameter or 1 to 500 microns, preferably from 10 to 350 microns, e.g., about 250 microns, circulated by a stirrer or stirrers so as to be periodically brought into contact with the cathode so that it may be "captured" and held thereto by metal being plated out. In a preferred form of the invention the cathode is maintained in a horizontal or substantially horizontal position so that the force of gravity will assist in bringing particles of the radioactive waste into contact with the cathode and thereby will facilitate codeposition. After completion of codeposition on one side of the cathode the position thereof may be reversed 180° or so to facilitate codeposition on the other side thereof (or the cathode can be moved continuously). Of course, the cathode may be positioned differently, agitation may be utilized or may be dispensed with, and if used may be increased, decreased or changed in type, to obtain best results, and other modifications may be made in the electrodeposition and codeposition processes without departing from the invention. For example, instead of depositing finely divided particles of the radioactive waste, such particles may be pelletized (preferable) or formed into filaments or fibers and such may be held to a cathodic material by a matrix being plated out thereon. The filaments may be of various dimensions, usually being of diameters in the range of 0.2 mm. to 2 mm. and of lengths from 0.5 to 10 cm. The pellets or otherwise compacted or solidified wastes will usually be of dimensions in the range of 0.01 cm. to 5 cm., e.g., 0.1 cm. to 1 cm. The pellets may be in various shapes, such as capsular, cylindrical, cubic, spherical, parallelepipedal, etc. Also the radioactive waste may be pressed or extruded to screen, helix, spaghetti or other forms for electrolytic binding.

The conditions of the electrolyte and the electrolytic cell may be varied depending on the characteristics of the metal or alloy being plated out, the radionuclide compounds present and the type of electrolysis being employed. Normally, direct current will be utilized but it is within the invention to superimpose an alternating current thereon. The concentration of metal ions in the electrolyte will usually be in the range of about 0.1 to 500 g./l., preferably 1 to 250 g./l., and when the radionuclide compounds are present in particulate forms their sizes will be in the range of about one micron to about one mm. in diameter, e.g., 0.01 to 0.1 mm. Normally, the concentration of radionuclide-containing particles in the bath will be from 0.1 to 20% by weight, based on the weight of such particles plus the bath, the bath temperature will be from 10° to 80° C. and the current density will be from 0.001 to 0.4 ampere/sq. cm., preferably from 0.01 to 0.2 ampere/sq. cm. The time for electrodeposition may vary over a wide range, depending on the deposit thickness desired. Usually it is from 5 minutes to 48 hours, preferably 1 to 6 hours. Voltages and current flows will depend on the material being plated out and on cell sizes. Usually these will be expected to be from 1 to 8 volts and from 1 to 1,000 amperes. The weight of waste material deposited, whether as particles, pellets or other shapes, will usually be from 0.1 to 90% of the weight of the final product, including cathode, matrix, and overcoating, e.g., 1 to 70% and 5 to 50%.

In some cases it is desirable for the particles, pellets or fibers being bound to the cathode to be made more conductive. Normally, such particles, etc., are of poorly crystalline and poorly conductive materials, such as the oxides of the radionuclides and accompanying non-radioactive materials. Because it is highly desirable to decrease solubility and increase electrical conductance of the particles and pellets in the electrolyte before entrapment in the plated out metal matrix, and to promote the holding of radionuclide-containing compound particles and pellets to the cathode, it has been found useful to coat such particles or mix with them (or the pellets or fibers or mixture of any thereof) a conductive material, such as a metal or graphite. Preferably, the metal employed is one of the metals which may be plated and more preferably it will be the same as the metal being plated. Furthermore, it is also preferable that such metal be the same as that of the cathode. Normally, the percentage by weight of such conductive material will be from 0.1 to 95% of the total weight of such material plus the radioactive waste (including non-radioactive material present with the radionuclide compound), preferably being from 70 to 95% thereof when the conductive and waste materials are mixed before pelletizing, and from 0.1 to 5% when the pelletized waste is coated with the conductive material. The particle sizes of the conductive material will be very much smaller than those of the radioactive waste, e.g., 0.01 to 0.2 times the diameters, to facilitate covering of the waste particles. It has been found, as is illustrated in FIG. 11, that external metal sputtering of pellets may not be as helpful in assisting in their codeposition on cathodic materials as is the physical mixing of the conductive material with the particulate waste before pelletizing. Still, it may be desirable to partially or completely cover surfaces of pellets and powders by sputtering, electrolysis, electroless coating, cladding or other suitable method, rather than to mix with them powdered or particulate conductive material, and often it will be preferred to effect such covering rather than to attempt to codeposit metal electrolytically with untreated radioactive waste material in particulate or larger solid form.

The following examples illustrate but do not limit this invention. Unless otherwise indicated all parts are by weight and all temperatures are in °C.

EXAMPLE 1

An electrolytic cell similar to that illustrated in FIG. 4, but with the anode positioned horizontally (instead of vertically) with respect to the cathode, is assembled, utilizing a four-liter Pyrex glass beaker, insulated leads to the electrodes from a source of direct current, and suitable electrodes, the upper surface of the cathode of which is to act as a base for solid state calcined radioactive waste material and metal matrix therefor to be electrodeposited. The anode and cathode are both 8 cm. in diameter and are about 3 mm. thick. They are both of pure copper in this experiment, with the anode being attached to the end of a vertically mounted copper bus bar and with the cathode being suspended about 3 cm. beneath it by insulated copper wiring. The external direct current power source is connected to the bus bar and the mentioned wiring so as to make them, respectively, positive and negative. A magnetic stirrer is positioned beneath the cathode to circulate the electrolyte and particulate waste material, as desired. The surfaces of the cathode are roughened, as by scratching (grooving and knurling may be employed instead), sometimes to depths of from 0.1 mm. to 2 mm., to facilitate positioning, lodging and sealing of the solid state calcined radioactive waste particles on the upper surface of the cathode.

To the electrolytic cell are added about 2.8 liters of electrolyte, the composition of which is 200 grams of copper sulfate pentahydrate, 50 grams of concentrated sulfuric acid and 2 grams of sulfonated phenol per liter. The sulfonated phenol, a surface active agent which aids in producing high quality copper plating on the cathode, is made by heating one part of phenol and one part of concentrated sulfuric acid and holding the mix at a temperature of 120° C. for one hour. The temperature of the electrolyte is maintained only a few degrees centigrade above the ambient temperature, usually in the range of 10° to 40° C., and preferably 20° to 30° C., during the electrodeposition process, but higher temperatures can be used. A simulated Savannah River sludge is employed as the radioactive waste to be codeposited with a metal matrix. The sludge is made by weighing out the following materials, mixing them and mixing deionized water with portions of the resulting mixture. Thus, in a five gallon polyethylene bottle (18.9 liters) there are mixed together in a dry state 3 kg. $FeCl_3$; 0.6 kg. $Al(OH)_3$; 0.5 kg. $MnO_2$; 0.3 kg. Linde molecular sieve AW 500; 0.3 kg. $Ni(OH)_2$; 0.24 kg. $UO_2SO_4.3H_2O$; 0.2 kg. $CaCO_3$; 175 g. $SiO_2$; 73 g. $H_g(NO_3)_2.H_2O$; 50 g. $Nd(NO_3)_3.5H_2O$; 43.7 g. $Sr(NO_3)_2$; 32.8 g. $CsNO_3$; 26 g. $La(OH)_3$; 25 g. $Ce(OH)_4$; 13.7 g. $Y(NO_3)_3.6H_2O$; 10 g. $RuCl_3.2H_2O$; 9.8 g. $Eu_2(SO_4)_3.8H_2O$; 9.2 g. $Pr_2(SO_4)_3.8H_2O$; 9.1 g. $Sm_2(SO_4)_3.8H_2O$; 7.5 g. $SnCl_2.2H_2O$; 6.8 g. $AgNO_3$; 5.0 g. $Cd(OH)_2$; and 5.0 g. $Co(OH)_2$.

After addition of the various powdered chemicals to the bottle it is sealed and tumbled on an electric rolling device for 36 hours to obtain extremely thorough mixing. Sludge samples for calcining and subsequent deposition in particulate or capsular form are then prepared by mixing together 400 ml. of deionized water with 18.3 g. of the mixed powder. The resulting dispersion or simulated "sludge" (dilute) is stirred and allowed to stand for about 25 minutes, after which 15 g. of sodium hydroxide are added, with stirring, and stirring is continued until the sodium hydroxide is dissolved. The resulting sludge is allowed to stand for about 18 minutes and is then stirred again, after which it is filtered sequentially, using Whatman 541 and Whatman 50 filter papers. The sludge is then calcined (and the filter paper is burned off) by firing for eight hours at 850° C. in a kyanite crucible. The dried calcined sludge cake resulting is then ground, using an agate mortar and pestle, to a size fine enough so that it passes a 60 mesh (U.S. Sieve Series) screen (so that the particles are less than 250 microns in diameter).

In a first codeposition experiment under this example the calcined simulated radioactive waste material, which behaves physically, chemically and electrolytically like a corresponding actually radioactive waste, is stirred into the 2.8 liters of electrolyte after an initial plating of copper onto the cathode to provide a receptive surface, and plating out of copper from the electrolyte onto the copper cathode is resumed. During such plating the stirrer is operated so as to create a gentle circulation of the electrolyte and the dispersed calcined material, which is initially largely in oxide form and in the electrolyte during the codeposition process is a mixture of metal oxides, oxyhydroxides and hydroxides, e.g., approximating equal parts of each. Electrolytic deposition of copper and codeposition of the waste material takes place, with the applied voltage being in the range of 1.5 to 2.5 volts, e.g., about 2.0 volts and with the current being in the range of 1 to 5 amperes, e.g., 3 amperes, so that the current density is from 0.01 to 0.1 ampere/sq. cm. The bath temperature is maintained in the range of 20° to 30° C., e.g., 25° C., and copper builds up on the cathode (on all surfaces thereof) at the rate of about 1–1.5 mm./day on each surface. Thus, after two days operation about 2.5 mm. of copper has deposited on the upper surface of the cathode and has codeposited with it a significant proportion, more than 10%, of the simulated radioactive waste particles. FIG'S. 6–8 are views of a polished cross-section of the codeposited surface resulting. Such products also result when the copper cathode upper surface is roughened initially by scratching, either with or without plating of metal thereon before codeposition, but often good coatings are also produced on untreated smooth surfaces, too.

In similar experiments the dry particulate material is first made more electrically conductive by sputtering gold onto the surface thereof in one case and mixing with it a slurry of colloidal graphite, in another case, with the proportions of such materials being about 0.01 and 10%, respectively. When such powders are codeposited in the same manner as described for the uncoated particles similar results are obtained and in cases where the codeposition may be improved by increasing the conductivity of a substantially non-conductive, poorly crystalline calcined radioactive waste material, the utilization of gold or other metal or graphite coating is significantly advantageous.

In another version of the experiment the calcined radioactive waste is allowed to settle on a part of the upper surface of the cathode, either before electroplating of copper thereon or after initially plating such surface, and then codeposition is effected, either with or without stirring of the electrolyte. In such operation finely divided metallic particles may be mixed with the powdered waste material to promote codeposition.

After application of the codeposited material to the one surface of the cathode it may be turned over (reversed 180°) to permit subsequent coating of the other surface thereof (which may have had a relatively more "dilute" content of waste material coated thereon beforehand). If desired, the initial lower surface may be coated with a protective film to prevent deposition of metal thereon before it is turned the 180°. While flat and relatively thin rounded rectangular cathodes are usually preferable, the cathodes may also be of other shapes, e.g., circular (as in these experiments), elliptical, curved, warped and corrugated.

In the above-described experiments the rate of codeposition and the thickness of the codeposited material may be increased by increasing the current flow and current density and by utilizing greater concentrations, e.g., 2 to 10 times those of the described calcined material and metal for codeposition. Also, of course, increased thicknesses of deposits can be obtained by running the processes for longer times. Instead of using copper for the cathode other base materials and alloys and even other conductive non-metallic cathodes may be employed. Among such are steel, stainless steel, iron, silver, graphite, brass and bronze. The composition of the electrolyte may be changed accordingly so as to be more compatible with the cathode material. Similarly, the plating metal may be changed to one of the described metals or to a suitable mixture of metals to plate out an "alloy". While it is preferred that the cathode and plating metal or alloy be the same, such is not required. However, it is highly desirable that the electrodeposited metal or alloy be one which is sufficiently corrosion resistant and of sufficient malleability and tensile strength so as to be capable of resisting corrosion by environmental materials and of resisting loss of integrity due to tectonic forces during underground storage.

Instead of covering both sides of a cathode only one side thereof need be covered with the codeposit, and if desired the electrocodeposit is stripped from the cathode for storage and the cathode is used again.

To provide further protection for the codeposited radioactive sludge material of the foregoing experiment it is further plated under the same conditions with pure copper metal, as described, or with other metal or alloy coating of desired properties, without depositable radioactive waste material being present. This is effected by using a different plating bath and re-connecting the cathode therein but may also be carried out in the same bath after deposition of all the radioactive waste material on the cathode or after settling of any remaining such material to the bottom of the cell (without use of the stirrer which would otherwise objectionably circulate such waste so as to codeposit it). The thickness of the metal plating may be as is best under the circumstances but usually will be from 0.001 to 0.1 cm.

EXAMPLE 2

In addition to the experiments described above, conducted utilizing fine sludge particles, the method of the present invention has also been employed to codeposit larger solid bodies of simulated radioactive sludge or of materials containing such sludge. Thus, cylindrical pellets 1.3 cm. in diameter and about 0.6 cm. thick have been made by high pressure pressing (at about 2,500 kg./sq. cm.) of the sludge particles described in Example 1 and have been held by a matrix of codeposited metal or alloy. In variations of this experiment the powdered simulated sludge was precoated with a conductive and hydrophobic layer of colloidal graphite (1%), was coated with a sputtered metal (gold) coating and was mixed with copper particles having an average particle size in the 1 to 5 micron diameter range, in weight proportions of 80:20 and 90:10 calcined waste:-copper. The pellets were placed in position on the copper cathode, resting on the top thereof in pre-formed grooves or depressions therein so as to maintain them in position, and electrodeposition of the copper plating was begun, as described in Example 1. After two days of such electroplating it was found that the various pellets were tightly bound in the metal matrix deposited on the cathode, as was the case in Example 1. However, as is seen from FIG'S. 10 and 11, the pellets of uncoated and of metal sputtered materials did not maintain their shapes as well during the electrodeposition process as did the pellets made from graphite coated calcined sludge and those made from mixed metal particles and calcined sludge.

The experiments of this example are conducted in manners similar to those described with respect to Example 1. Thus, the types of metal coatings and thicknesses thereof are altered, and processing conditions are changed. The cathode is reversed in position so as to permit deposition and binding of other pellets to the matrix of metal on the other cathode side. During deposition of the metal finely divided particles of calcined wastes are sometimes dispersed in the electrolyte so that these codeposit with the metal matrix while the pellets are also being held in place by the matrix material. Instead of pellets, fibrous forms of the wastes may be employed and such fibers may be composed of waste particles dispersed in polymeric synthetic organic plastics, e.g., nylon, polyesters, polystyrenes. Also, instead of powders or pellets of the calcined wastes, such wastes may be incorporated first in glasses (by known methods presently practiced) or ceramics, in powder or fiber forms, and may thus be codeposited as finely divided particles or may be held in place as pellets or other shaped bodies, in the manner herein described. Instead of employing calcined wastes the wastes may be employed in other particulate form, preferably in a form insoluble in the electrolyte. Thus, the radionuclide compounds of the waste solution described may be sorbed by minerals, such as zeolites (natural and synthetic), clays and various mixtures thereof and such powders can be held to substrates (and matrix materials) by the methods of this example. Even when soluble waste particles are utilized they may be insolubilized by encapsulation by thin films of electrolyte-insoluble materials, such as the mentioned polymeric plastics, or other suitable coatings.

EXAMPLE 3

What is characterized as a PW-4b calcine, simulating wastes from reprocessing spent Zircaloy-clad uranium oxide fuel elements from a pressurized reactor by the Purex process, is obtained from Battelle Northwest Laboratories. Such waste is made by mixing together 63 grams of concentrated nitric acid; 2.51 grams of 85% phosphoric acid; 44.04 grams of $Fe(NO_3).9H_2O$; 4.80 grams of $Cr(NO_3)_3.9H_2O$; 10.76 grams of $Ni(NO_3)_2.6H_2O$; 16.85 grams of $MoO_3$; 5.71 grams of $Sr(NO_3)_2$; 7.06 grams of $Ba(NO_3)_2$; 10.53 grams of $CsNO_3$; 1.01 grams of $KNO_3$; 28.33 grams of $Zr(NO_3)_2.2H_2O$; 2.91 grams of $Co(NO_3)_2.6H_2O$; 1.92 grams of $TeO_2$; 0.34 gram of $AgNO_3$; 0.62 gram of $Cd(NO_3)_2.4H_2O$; 5.27 grams of $UO_2$; 36.51 grams of $Ce(NO_3)_3.6H_2O$; 34.69 grams of $Nd(NO_3)_3.6H_2O$; 11.87 grams of $La(NO_3)_3.6H_2O$; and 8.22 grams of $Pr(NO_3)_3.6H_2O$, making up the mixture to one liter with distilled water, evaporating to dryness, calcining at 500°–600° C., and grinding to particle sizes such as pass a 325 mesh (U.S. Sieve Series) screen, which particles will be less than 45 microns in diameter. The PW-4b calcine is pelleted in the manner described in Example 2 and copper is electrodeposited on a copper cathode so as to hold the pellets to it, as described in such example. Results of such codeposition are shown in FIG. 10. Instead of plating the pellets to the cathode the powdered PW-4b calcine described may be electrocodeposited by the method described in Example 1.

The pellets or powders of simulated calcined Purex process waste are firmly held in the copper (or other metal matrix) but in many instances they may be readily removable from the cathode, if desired. Then the removed articles may be employed as cathodes for subsequent codepositions of waste matrix material or the cathode parts may be reused.

In this and the other examples, especially when powdered simulated or actual radioactive waste is being codeposited onto the cathode with a matrix material, with the aid of gravity, so as to avoid possible deposition on the top surface of the anode and effective removal of such waste from the codepositing process the horizontal anode may be replaced by one resembling that of FIG. 1 and similar results are obtainable. Instead of employing electrolytic deposition of the matrix material, electroless depositions may be utilized so as to codeposit both matrix and waste products or to hold larger waste bodies to a base. The principles of this invention may also be applicable to encasing other waste substances than radioactive material in continuous matrices for their storage or ultimate disposal.

In all the cases of the above examples, when the metal matrix-waste material, preferably coated with metal, too, is temporarily stored or is ultimately disposed off, as by underground storage in salt mines, deep wells, trenches or caverns, due to the improved malleability, resistance to stresses and corrosion resistance of the invented articles, compared to glasses and ceramics of the prior art and to wastes sintered with metals, greater resistances to tectonic forces and to corrosion by underground environments are the intended results, so that safer storage and disposals of radioactive materials are obtained.

In the examples given the materials processed are simulated radioactive wastes but the same examples are operative when all or parts of the components of such wastes are radioactive and it is considered, in view of the similar physical and chemical properties of radioactive and non-radioactive elements and compounds, that the above examples are also examples of treatments of radioactive waste products. Normally, such radioactive wastes will include from 0.1 to 100%, often 0.1 to 20%, e.g., 5% to 10%, of radioactive compounds, and approximately the same percentages will be present in the calcined products. Preferably such calcined products will include the oxides and more preferably most or essentially all of them will be of such oxides, although oxyhydroxides and hydroxides have been found to codeposit well, too, as in equal weight mixtures with the oxides from aqueous systems. The percentage of calcined or other radioactive waste in the matrix will usually be 5 to 50%, or 10 to 30% by weight of the total, e.g., 10 and 15% (including the cathode weight). While various other radionuclides may also be present in the wastes, the present invention is of particular importance when strontium 90 and cesium 137 are entrapped in the metallic matrices, as described herein, because such are biologically very hazardous radionuclides which are presently important constituents of radioactive wastes and which are expected to be present in relatively even more significant quantities as the amounts of such wastes increase in the future. Such radionuclides and other radionuclides may be present as oxides, oxyhydroxides and hydroxides and/or may be present in other forms and in solid solutions of other radionuclide compounds and compounds of non-radioactive elements in the mentioned wastes.

The present invention has many advantages over various prior art methods for the disposal of radioactive wastes and several of these advantages have already been mentioned. Primarily, the described method is readily practiced at convenient temperatures (below 100° C.) and with readily available equipment and produces an article for disposal which is stable to temporary and permanent disposal conditions and environments. Among the other advantages of the invention is the depositing of the radioactive wastes (which may contain a plurality of radionuclides) by an electrolytic (or electroless or double displacement) method wherein the E.M.F. position of the radionuclide metal is not a controlling factor, as it can be for normal platings of materials from solution.

Various modifications of the invention may be made, which will assist in achieving the mentioned goals and will otherwise improve the invented products and processes. For example, instead of starting with a compressed powder of a mixture of metal and radioactive waste, such initial pellet may be made by sintering and may subsequently be held to a base and/or held together by electrodeposition of a metal or metal matrix, with or without additional powdered radioactive waste material being present and being codeposited and with or without subsequent overcoating. The electrodeposition of a protective pure metal surface coating may be effected in the same bath as is used for the initial codeposition after codepositing all or substantially all of the radioactive waste material present. The process may be operated batchwise or continuously, with additions of both metal compounds for plating and radioactive wastes being made periodically, and portions of the wastes and electrolytes may be recycled, purified and otherwise processed. Hooks or holders may be incorporated in the cathode and/or in the matrix so as to provide ready means for lifting or fastening the end product to carriers or holders and pellets may be held to the cathodes before electrodeposition by such holders, on a much smaller scale. The electrocodeposition may be halted at any of various suitable stages, such as when the radioactive waste dispersed in the electrolyte is diminished to 5 to 95% or 10 to 30% of its initial "concentration". The codeposited material, excluding the cathode, may have from 2 to 90% or 5 to 80% (but usually 5 to 50% will suffice) of radioactive waste material therein (not all of which is radioactive). Zeolites, such as Zeolite A, that are utilized to extract radioactive materials from liquid wastes, may be employed in place of the calcined sludges or in mixture therewith and thereby are readily made into stable disposable articles of this invention.

In addition to the use of previously described methods for improving the surface conductivity of the waste material, such may also be improved by coating the particles, pellets or fibers thereof with a suspension of metal powder by mixing the calcined powder with a colloidal dispersion of a metal or by coating the waste with carbon or a metal by means of vapor deposition, plasma spraying or a chemical reaction, e.g., by spraying with jets of ammoniacal silver nitrate and formaldehyde or hydrazine to produce a metallic coating (silver in the last case), on the surfaces of the waste materials.

The character of the electrodeposit may be varied by the use of additives for the plating bath, which are known in the industry to be able to change the type of plating, as by making it shinier, smoother, more lustrous, duller, etc. Also, the type of electrolyte may be varied so as to make it more compatible with the radioactive waste being deposited, when that is desirable. Instead of utilizing the calcined oxides, oxyhydroxides and hydroxides, radionuclide oxyhalides and halides may often be employed. Instead of copper plating, as is principally shown in the examples, cobalt, nickel, cobalt-boron and nickel-boron "alloys" and noble metals may be employed. Such are often depositable by electroless plating means, either as exterior coatings or as a matrix for the radioactive wastes. In cases where the matrix is removed from the cathode such matrix may subsequently have corrosion resistant metal or alloy electroplated thereon so as to protect all surfaces thereof, including the newly exposed surface which previously was joined to the cathode. Similarly, sintered products in which radioactive material is held in a sintered metal matrix may be so plated. Of course, the present products are superior to sintered products because the codeposited matrix is continuous and covers the radioactive wastes better, making them less accessible to a corrosive environment. Also, the present products are stronger than the unincorporated calcined wastes and are more resistant to storage and transportation stresses.

Although various embodiments of the invention have been disclosed it is not to be limited to these because it is considered that one of skill in the art, with the present specification before him, will be able to utilize equivalents and substitutes without departing from the invention.

What is claimed is:

1. A method for converting radioactive waste material into a stable article for disposal or storage which comprises electrolyzing a bath containing ions of a corrosion-resistant electrodepositable metal or of a plurality of materials including at least one such metal, in the presence of a solid state radioactive waste material which contains a radionuclide selected from the group consisting of strontium 90 and cesium 137 and mixtures thereof in one or more oxide and/or oxyhydroxide and/or hydroxide forms so that the metal or materials including metal is/are deposited on a cathode and bind(s) the radioactive waste thereto.

2. A method according to claim 1 wherein the electrodepositable metal or mixture of metals is selected from the group consisting of non-radioactive copper, nickel, iron, chromium, lead, tin, zinc, manganese and cobalt and mixtures thereof and the radionuclide(s) is/are in poorly crystalline oxide and/or oxyhydroxide and/or hydroxide form.

3. A method according to claim 2 wherein the metal is copper, nickel or chromium and the radionuclide is present as an oxide.

4. A method according to claim 3 wherein the radionuclide-containing oxide is present as finely divided particles and is brought into contact with the cathode or a coating thereon by mechanical, convective, gravitational or electrophoretic means during electrodeposition on the cathode of the electrodepositable metal or a mixture of such metals.

5. A method according to claim 4 wherein the cathode surface is of a non-radioactive metal or alloy, the bath is an aqueous bath, the radionuclide compound is of a particle size in the range of about 10 microns to about 350 microns in diameter, the concentration of metal ion(s) in the bath is from 1 to 250 g./l., the concentration of radionuclide-containing particles in the bath is from 0.1 to 20% by weight, the bath temperature is from 10° to 80° C., the current density is from 0.001 to 0.4 ampere/sq. cm. and the thickness of the deposit of radionuclide-containing material and metal or alloy is from 1 mm. to 1 m.

6. A method according to claim 5 wherein the radionuclide-containing strontium and/or cesium oxide(s) result(s) from calcining radioactive weapons wastes and/or nuclear fuel reprocessing wastes and the thickness of the deposit of radionuclide-containing material and metal or metal alloy is from 1 mm. to 5 cm.

7. A method according to claim 6 wherein after codeposition of the radionuclide-containing material and metal or metal alloy the resulting coated cathode is overcoated with a metal or metal alloy.

8. A method according to claim 7 wherein the product resulting is disposed of by storage underground, in which storage it is of improved stability due to its resistances to corrosion and failure under stress.

9. A method according to claim 5 wherein the cathode is substantially horizontally positioned and after codeposition of radionuclide and metal on an upper surface thereof, is moved to a different substantially horizontal position for further codeposition on the then upper surface so as to promote even covering of such surfaces with such deposit.

10. A method according to claim 9 wherein the cathode is substantially flat and is positioned horizontally initially, after which it is rotated 180° about a longitudinal horizontal axis and codeposition is continued.

11. A method according to claim 10 wherein after codeposition of radionuclide and metal on both sides of the substantially flat cathode the resulting article is overcoated with a metal or metal alloy.

12. A method according to claim 2 wherein the radionuclide material is pelletized or agglomerated before codeposition.

13. A method according to claim 2 wherein the radionuclide compound material is made electrically conductive prior to deposition in the electrolyte bath.

14. A method according to claim 2 wherein the product resulting is disposed of by storage underground, in which storage it is of improved stability due to its resistances to corrosion and failure under stress.

15. A method according to claim 14 wherein the metal is copper, the radionuclide compounds include a mix of radioactive cesium and strontium oxides and the article resulting is subsequently coated with copper.

16. Radioactive waste material in stable physical article form which comprises an electrocodeposited solid matrix of corrosion-resistant metal or mixture of metals with a radionuclide selected from the group consisting of strontium 90 and cesium 137 and mixtures thereof therein as insoluble oxide(s) and/or oxyhydroxide(s) and/or hydroxide(s) in a different solid phase or in different solid phases from that of the metal.

17. A radioactive article according to claim 16 having an inner core of non-radioactive material, a covering over major surfaces of such core of a matrix of non-radioactive metal or mixture of such metals with the insoluble radionuclide compound or a mixture of such radionuclide compound(s) therein, in separate solid phases, the radionuclide compound(s) being held to the core by the matrix, and a continuous coating thereover, so that the radioactive article is in stable physical form, suitable for disposal underground, wherein it resists corrosion and underground stresses and maintains the integrity of the core-metal matrix-radionuclide compound structure and hinders or prevents release of radioactive material therefrom.

18. A radioactive article according to claim 17 wherein the inner core is of copper, the matrix is of copper, the radionuclide material distributed in the matrix is particulate and is selected from the group consisting of strontium 90 and cesium 137 and mixtures thereof, and the continuous coating over such matrix and particulate material distributed therein is of copper.

19. A radioactive article according to claim 17 wherein the radionuclide compound includes strontium 90.

20. A radioactive article according to claim 19 wherein the radioactive material is a calcined radioactive weapons plant sludge.

21. A radioactive article according to claim 19 wherein the radioactive material is a mineral which contains radioactive waste elements.

22. A radioactive article according to claim 19 wherein the radioactive material is a glass or ceramic formed from radioactive waste sludge.

23. a radioactive article according to claim 19 which is of substantially thin flat shape, with substantially equal thicknesses of metal matrix-particulate radionuclide compound deposits on major surfaces thereof and with an electrodeposited copper coating about the deposits of such material.

* * * * *